US005503955A

United States Patent [19]

Snelling et al.

[11] Patent Number: 5,503,955

[45] Date of Patent: Apr. 2, 1996

[54] PIEZO-ACTIVE PHOTORECEPTOR AND SYSTEM APPLICATION

[75] Inventors: Christopher Snelling; Joseph Mammino, both of Penfield; Dale R. Mashtare, Macedon, all of N.Y.

[73] Assignee: Xerox Corporation, Stamford, Conn.

[21] Appl. No.: 167,291

[22] Filed: Dec. 16, 1993

Related U.S. Application Data

[63] Continuation-in-part of Ser. No. 870,742, Apr. 17, 1992, Pat. No. 5,276,484, which is a continuation of Ser. No. 625,351, Dec. 11, 1990, abandoned.

[51] Int. Cl.[6] ..... G03G 15/08

[52] U.S. Cl. ..... 430/127; 430/56; 430/62; 430/63; 430/128; 430/98; 430/131; 430/135; 355/211; 355/212; 355/213

[58] Field of Search ..... 430/56, 62, 63, 430/127, 128, 98, 131, 135; 355/211, 212, 213

[56] References Cited

U.S. PATENT DOCUMENTS

| | | | |
|---|---|---|---|
| 3,140,199 | 7/1964 | York | 118/637 |
| 3,653,758 | 4/1972 | Trimmer et al. | 355/16 |
| 3,799,775 | 3/1974 | Petruzzella | 96/1.5 |
| 4,106,933 | 8/1978 | Taylor | 96/1.5 R |
| 4,111,546 | 9/1978 | Maret | 355/15 |
| 4,377,629 | 3/1983 | Tarumi et al. | 430/62 |
| 4,392,178 | 7/1983 | Radice | 361/233 |
| 4,456,670 | 6/1984 | Nakayama et al. | 430/63 X |
| 4,529,292 | 7/1985 | Ohseto | 355/211 |
| 4,546,722 | 10/1985 | Toda et al. | 118/657 |
| 4,760,422 | 7/1988 | Seimiya et al. | 355/253 |
| 4,766,457 | 8/1988 | Barker et al. | 355/3 DD |
| 4,833,503 | 5/1989 | Snelling | 355/259 |
| 4,987,456 | 1/1991 | Snelling et al. | 355/273 |
| 5,005,054 | 4/1991 | Stokes et al. | 355/273 |
| 5,010,369 | 4/1991 | Nowak et al. | 355/273 |
| 5,016,055 | 5/1991 | Pitrowski et al. | 355/273 |
| 5,025,291 | 6/1991 | Nowak et al. | 355/273 |
| 5,030,999 | 7/1991 | Lindblad et al. | 355/297 |
| 5,081,500 | 1/1992 | Snelling et al. | 355/273 |
| 5,276,484 | 1/1994 | Snelling | 355/211 |

FOREIGN PATENT DOCUMENTS

| | | |
|---|---|---|
| 63-0080225 | 4/1988 | Japan . |
| 2-0033155 | 2/1990 | Japan . |

OTHER PUBLICATIONS

Patent Abstracts of Japan, vol. 9, No. 50, 5 Mar. 1985 & JP–A–59 189 356, 26 Oct. 1984 (Matsushita Denki Sangyo).

IS&T's Eighth International Congress on Advances In Non–Impact Printing Technologies (Oct. 1992), Crowley et al.: *Acoustically Assisted Xerographic Toner Transfer,* pp. 91–95.

Chapman and Hall, N.Y., first published by Blackie & Son Ltd., Glasgow & London (1988); T. T. Wang et al.: *The Applications of Ferroelectric Polymers,* pp. 1–5.

*Primary Examiner*—Charles L. Bowers, Jr.
*Assistant Examiner*—Mark F. Huff
*Attorney, Agent, or Firm*—Kenyon & Kenyon

[57] ABSTRACT

A piezo-active charge retentive member, such as a photoreceptor, has a grounded electrode layer separating a photoreceptive layer and a piezo-active layer. External vibration sources become unnecessary since supplying an A.C. voltage across the piezo-active layer to the grounded electrode layer causes the piezo-active layer, and thus the entire photoreceptor, to vibrate. Vibration of the photoreceptor enhances the transfer of development powder from the photoreceptor to the transfer material, such as a sheet of paper. Vibration of the photoreceptor also improves the development of images and assists the cleaning of residual development powder from the photoreceptor surface.

31 Claims, 2 Drawing Sheets

PIEZO-ACTIVE PHOTORECEPTOR AND SYSTEM APPLICATION

This application is a continuation-in-part of application Ser. No. 07/870,742, filed on Apr. 17, 1992, now U.S. Pat. No. 5,276,484, which is a continuation of application Ser. No. 07/625,351 filed on Dec. 11, 1990, now abandoned.

BACKGROUND OF THE INVENTION

The present invention relates to an improvement in the transfer of particulate material from a photoreceptor element and the development and cleaning thereof, and in particular to the manufacture of a photoreceptor element comprising a piezoelectric component in an electrostatographic imaging device.

An example of an electrostatographic imaging device known in the art is described in U.S. Pat. No. 4,766,457 to Barker et al., assigned to the same assignee as the present application and is incorporated herein by reference. In such a device, developing powder, or toner, is transferred from a toner carrier to an electrostatographic image on a photoreceptor component. This developed image can then be transferred to paper or other printing material to form a more permanent representation of the electrostatographic image. Subsequently, the photoreceptor component is cleaned and the process can then be repeated.

In previous electrostatographic imaging devices, improved transfer from the toner carrier to the photoreceptor and from the photoreceptor to paper is achieved by agitating either the toner carrier or the photoreceptor. This agitation promotes the release of toner particles to the desired areas of development in the receptor.

As seen in U.S. Pat. No. 4,833,503, the development apparatus of a copying machine comprises a donor belt made of a piezoelectric polymer material. An external A.C. source supplies voltage to the belt through one of the rollers of the development apparatus. The net force of adhesion of toner to the belt is reduced through agitation of the piezoelectric belt surface. Therefore, an improved development of the final copy or print is achieved by the removal of more toner from the donor belt.

In U.S. Pat. No. 4,546,722, several methods for the removal of toner particles from the toner carrier are shown. In one method, a piezoelectric element is disposed in the carrier. An external A.C. source causes this piezoelectric element to vibrate, thus aiding in the release of toner from the carrier. In another method, the toner carrier is formed as a sheet having a piezoelectric layer. The carrier sheet is then securely clamped, and an A.C. source causes the entire sheet to vibrate having the results as mentioned above.

In U.S. Pat. No. 3,140,199, an external vibration mechanism is used to agitate the carrier belt. In U.S. Pat. No. 4,111,546, an external vibration mechanism is used to agitate the photoreceptor to remove toner residue. These vibration mechanisms can be acoustic or ultra-acoustic devices such as horns.

In U.S. Pat. No. 3,653,758, piezoelectric devices are coupled to the photoreceptor. If the photoreceptor is a plate, these piezoelectric devices can be disposed in a support structure for the photoreceptor. If the photoreceptor is a belt, these vibration devices can be placed in any of the rollers, around which the photoreceptor belt is moved.

In the previous methods mentioned above, external vibration devices or support structures agitate the photoreceptor or toner carrier. Space is provided in the copying system in order to incorporate these devices and support structures in the system. As the complexity of these copying systems increases, it becomes more difficult to provide space for these devices and support structures.

The systems described above under utilize space and lack cost efficiencies because of the need for external devices and support structures.

Furthermore, the quality of copy using such systems could be improved by transferring more toner during each stage of the copying process.

SUMMARY OF THE INVENTION

The deficiencies discussed above are overcome by the present invention. The charge retentive member of the invention described herein comprises a photoreceptive layer coupled to an electrode layer which in turn is coupled to a piezo-active layer, the latter made at least in part of piezoelectric materials. In operation, the electrode layer is coupled to ground as the structure moves throughout the system. An anti-curl back coating, such as a polycarbonate resin, can be added to the photoreceptive layer in order to produce flat lying properties of the photoreceptor, as a whole.

The entire photoreceptor is vibrated locally by positioning an A.C. corona device in close proximity to the photoreceptor. In an alternative embodiment, .a conductive component such as a conductive roller is coupled to the photoreceptor, and an A.C. source supplies an alternating voltage across the piezo-active layer to ground. The alternating voltage across the piezo-active layer causes the photoreceptor to vibrate locally. Vibrations in the photoreceptor improve the transfer of toner in the development, transfer, and cleaning stages. The electrode layer prevents the A.C. source from interfering with electrostatographic imaging on the photoreceptor. The present invention also has applications in ionographic imaging devices and laminated substrates.

In a further embodiment of the present invention, the piezo-active and electrode layers can be adhered to the photoreceptor using a two-sided pressure sensitive or heat-sensitive adhesive tape. Also, adhesive compounds alone can be used such as epoxies, silicones, etc. instead of an adhesive tape. Furthermore, the thickness of the electrode layer, the piezo-active layer and the adhesive compound or adhesive tape can be selected so as to produce the flat-lying properties of the photoreceptor in place of the anti-curl back coating.

The above is a brief description of some deficiencies in disclosed electrostatographic imaging devices and advantages of the present invention. Other features, advantages and embodiments of the invention will be apparent to those skilled in the art from the following description, accompanying drawings and appended claims.

DETAILED DESCRIPTION

Figure 1:
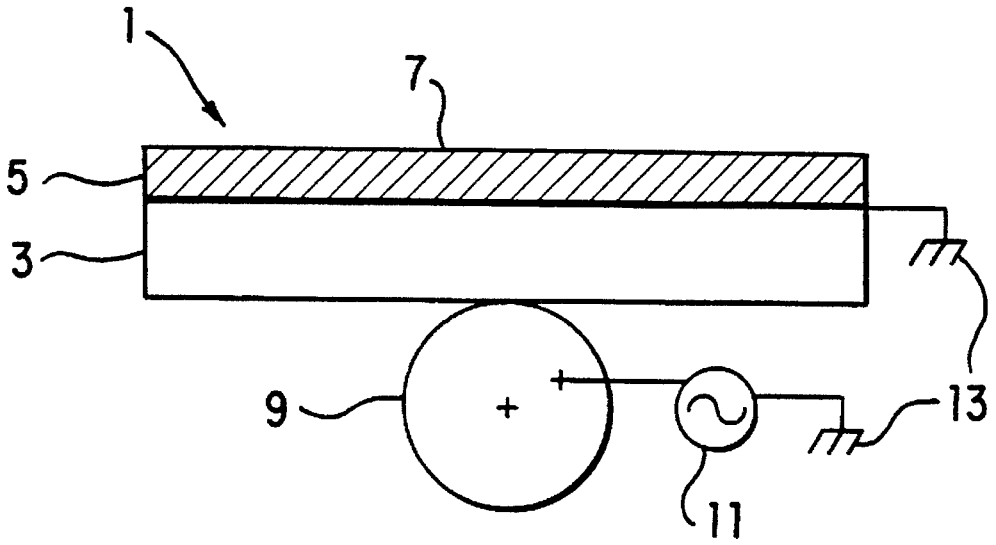
FIG. 1 is a schematic diagram of a section of a photoreceptor component constructed according to the present invention.

In the drawings, like reference numerals have been used throughout to designate identical elements. Referring to FIG. 1, a section of a charge retentive member, such as a photoreceptor component, of the present invention is shown. The photoreceptor component 1 has a structure that can be similar to conventional organic photoreceptor components. The photoreceptor component 1 is a tiered structure comprising three layers: a piezo-active layer 3, an electrode layer 5, and a photoreceptive layer 7.

The piezo-active layer 3 is made of a piezoelectric material such as, but not limited to, polyvinylidine difluoride (PVDF), which is more commonly known by the trade name, Kynar®. Other examples of piezoelectric material include: polyvinylfluoride, copolymers of vinylidine fluoride and trifluroethylene, Nylon-11 (γ phase), PZT-5, barium titanate ($BaTiO_3$), quartz, and triglycene sulfate (all of which taken alone, in mixtures, or as composites).

In previous photoreceptor components, a mechanical support layer is usually included to add rigidity to the photoreceptive layer. Similarly, the Kynar® material of the piezo-active layer 3 gives the photoreceptor component 1 the rigidity needed for proper electrostatographic reproduction.

The electrode layer 5 is made of a conducting material such as, but not limited to, aluminum. The photoreceptive layer 7 can be amorphous selenium, or any of several other materials or structures well known in the art for electrostatographic reproduction as taught, for example in U.S. Pat. No. 4,265,990 to Stolka. The photoreceptor layer 7 can also be a heterogeneous photoreceptor, such as the one shown in U.S. Pat. No. 3,121,006 (the disclosure of which is hereby incorporated by reference in its entirety), where finely divided particles of a photoconductive, inorganic compound are dispersed in an electrically insulating organic resin binder.

The electrode layer 5 is added between the piezo-active layer 3 and the photoreceptive layer 7 by printing, coating, lamination, electroplating, electroless metal deposition, etc., and can be continuous or segmented. As an example, an aluminum electrode layer 5 can be formed on the piezo-active layer 3 (e.g. a sheet of Kynar®) by vacuum deposition. Then, the photoreceptive layer 7 can be formed by evaporating amorphous selenium onto the aluminum electrode layer 5.

Figure 1A:
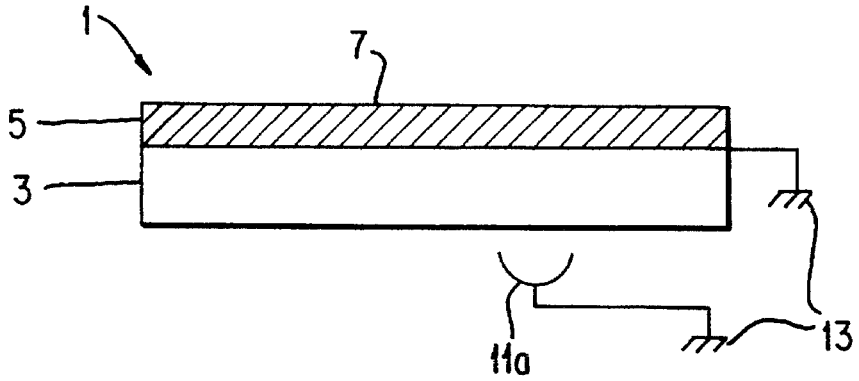
FIG. 1*a* is a schematic diagram of the photoreceptor component of FIG. 1 incorporating an A.C. corona device.
Figure 1B:
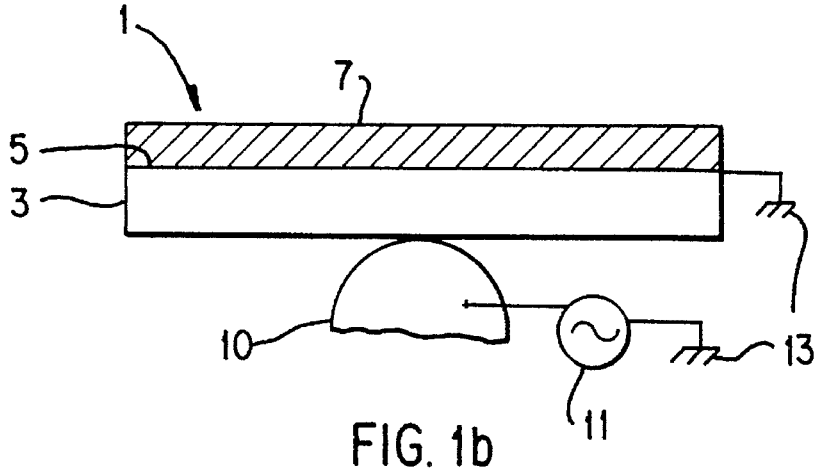
FIG. 1*b* is a schematic diagram of the photoreceptor component of FIG. 1 incorporating a shoe electrode.
Figure 1C:
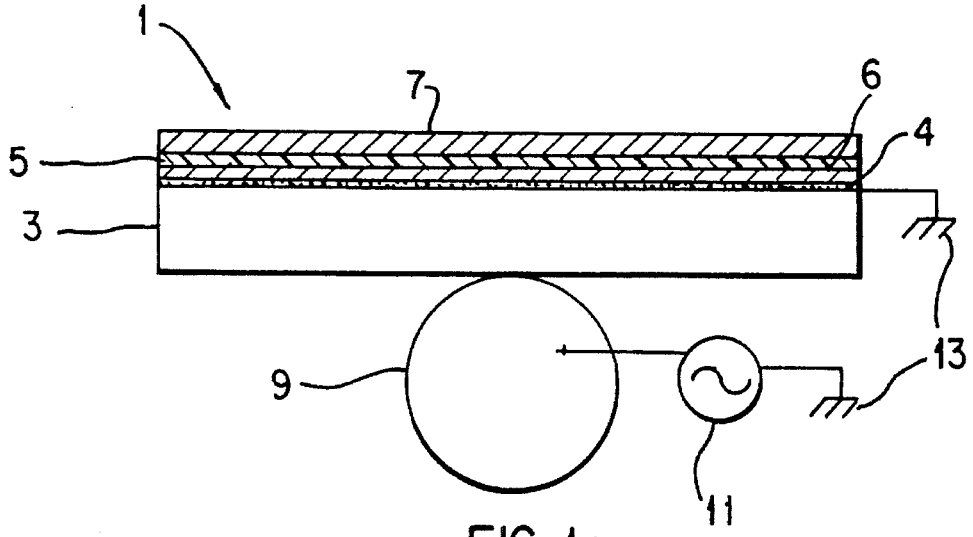
FIG. 1*c* is a schematic diagram of the photoreceptor component of FIG. 1 incorporating an adhesive between the photoreceptive layer and the electrode layer.

In a further embodiment of the present invention, the piezo-active layer 3 and electrode layer 5 can be adhered to the photoreceptor 7 using an adhesive compound or adhesive tape 4 (see FIG. 1*c*). Examples of the adhesive tape would include two-sided pressure-sensitive tapes such as industrial Scotch® brand adhesive tapes manufactured by Minnesota Manufacturing and Mining Corporation (3M); or heat-activated acrylate adhesive manufactured by E. I. DuPont de Nemours Corporation (DuPont). Examples of adhesive compounds include any of a variety of well known substances which include, but are not limited to, the following: polyurethanes, silicones, acrylates, cyano acrylates, polyesters, epoxies, polyimides, styrene butadine, polyvinylacetate, ethylene vinylacetate, ethylene acrylate, etc.

The adhesive can also be conductive, and thus function as both an adhesive and an electrode layer. The conductive-adhesive layer may be formed by adding conductive fillers such as silver, nickel, copper, carbon, graphite, indium, antimony-doped tin oxide, etc. to an adhesive such as a polyurethane, silicone, acrylate, cyanoacrylate, polyester, epoxy, etc. The fillers are dispersed in the adhesive by various milling, grinding and mixing processes and applied by dip spray, web, brush, etc. coating techniques.

In known photoreceptors, an anti-curl back coating 6, (see FIG. 1*c*) comprising, for example, 90% polycarbonate with a 10% polyester resin, is provided to the back side of the photoreceptive layer 7 in order to prevent curling. In other words, the anti-curl back coating 6 promotes the photoreceptive layer 7 to lie flat in the electrostatographic printing system. In the present invention, the thickness of the piezo-active layer 3, electrode layer 5, and the adhesive or adhesive tape layer 4, are chosen so as to provide the photoreceptive layer 7 with flat-lying properties so that the anti-curl back coating 6 is not needed.

The photoreceptor component 1 is coupled to a conductive roller 9 such that the piezo-active layer 3 comes in contact with the conductive roller 9. An A.C. source 11 is coupled between a ground 13 and the conductive roller 9. In an exemplary embodiment, the A.C. source 11 supplies a sinusoidal voltage to the piezo-active layer 3 via the conductive roller 9. The sinusoidal voltage causes the piezo-active layer 3 and, thus, the entire photoreceptor component 1 to vibrate. It should also be noted that the magnitude of the sinusoidal electric field will be greatest, and thus the piezo-active layer 3 will have the largest deformation, in the area near the conductive roller 9. A wide variety of frequencies can be used for this sinusoidal voltage. The frequency of the sinusoidal voltage can be in the acoustic range, such as 20 KHz–60 KHz. The amplitude of the sinusoidal voltage is chosen depending on the thickness of the photoreceptor component 1, the piezoelectric properties of layer 3, and the desired magnitudes of acoustic motion. The electrode layer 5 is also coupled to ground 13. Therefore, the sinusoidal voltage from the A.C. source 11 flows through the piezo-active layer 3 to ground 13. Grounding the piezo-active layer 3 prevents the sinusoidal voltage from interfering with the operation of the photoreceptive layer 7. It should be noted that the conductive roller 9 can also be a shoe electrode 10 (see FIG. 1*b*) and the photoreceptor component 1 can be dragged over this stationary electrode. Also, an A.C. corona 11*a* (see FIG. 1*a*) can be used instead of the conductive roller 9 and A.C. source 11 combination. An A.C. corona source supplies an alternating charge signal across the piezo-active layer 3 which also causes this layer to vibrate.

Figure 2:
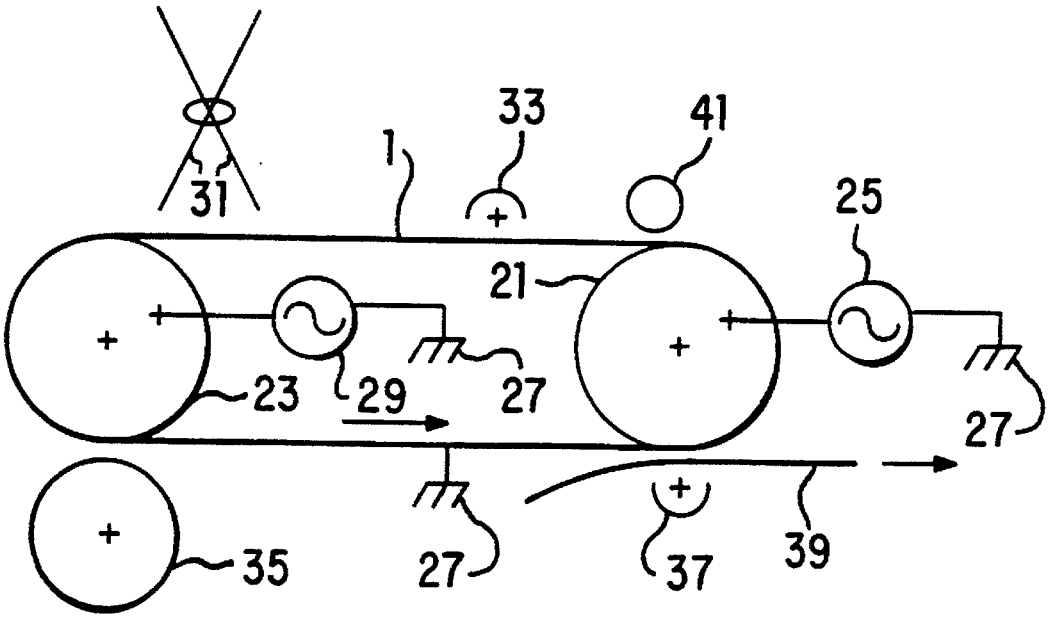
FIG. 2 is a schematic diagram of an electrostatographic reproducing system having a photoreceptor component constructed according to the present invention.

Referring to FIG. 2, an electrostatographic imaging device incorporating the piezo-active photoreceptor of the present invention is shown. In this embodiment, the photoreceptor component 1 is in the shape of a belt sleeved about a first conductive roller 21 and a second conductive roller 23. The photoreceptor component 1 can be a continuous, seamless belt. The photoreceptor component 1 moves around the conductive rollers 21 and 23 in the direction indicated by the arrow shown. A first A.C. source 25 is coupled between the first conductive roller 21 and a ground 27. A second A.C. source 29 is coupled between the second conductive roller 23 and ground 27. As shown in the description of FIG. 1 above, the A.C. source supplies a sinusoidal voltage through the conductive rollers 21 and 23 to the piezo-active layer 3 (not shown in detail) of the photoreceptor component 1. The electrode layer 5 (not shown in detail) of the photoreceptor component 1 is coupled to ground 27 to prevent the sinusoidal voltage supplied by the A.C. sources 25 and 29 from interfering with the photoreceptive layer 7 (not shown in detail).

During a typical operation of an electrostatographic imaging device, the photoreceptive layer 7 of the photoreceptor component 1 is first charged to a uniform potential by a first corona charging device 33. The photoreceptive layer 7 is then exposed to a light image 31 of an original document or print characters. The light image 31 discharges the photoreceptive layer 7 in printable character or background areas. The remaining charge on the photoreceptive layer 7 forms a latent electrostatic image which corresponds to the original document or printed characters. The latent electrostatic image passes around the second conductive roller 23 to a development area.

A developer carrier 35 supplies toner particles to the photoreceptor component 1 in the development area. In standard electrostatic reproduction devices, the toner particles will have a charge opposite to that of the latent electrostatic image on the photoreceptor component 1. The second A.C. source 29 causes the photoreceptor component 1 to vibrate in the development area. This vibration is imparted to the developer carrier 35 which causes carrier bead bouncing on the photoreceptive surface 7. Thus, an increased number of carrier bead-toner to photoreceptor contact events occur as compared to previous electrostatographic imaging devices. This results in an enhanced development by improving development statistics.

The developed image on the photoreceptor component 1 then passes to a transfer area for transferring the developed toner to paper. In the transfer area, the photoreceptor component 1 comes in contact with the first conductive roller 21. A second corona charging device 37 is located near the first conductive roller 21. A sheet 39 made of a transfer material such as paper is transported between the second corona charging device 37 and the developed image on the photoreceptor component 1 in a known method. The second corona charging device 37 attracts the developed toner onto the sheet 39. The first A.C. source 25 causes the photoreceptor component 1 to vibrate in the transfer area. By vibrating the developed image on the photoreceptor component 1, the net force of attraction holding toner particles to the photoreceptive layer 7 is reduced causing more toner particles to be drawn towards the second charge potential 37, and ultimately sheet 39. This transfer occurs as sheet 39 is transported through the transfer area in the direction of the arrow. The transferred toner is later permanently affixed to the sheet 39 by either the application of pressure, heat or any of other known methods.

Any residual toner still attached to the photoreceptor component 1 after passing the transfer area passes on to a cleaning area. The area on the photoreceptor component 1 that has attached residual toner remains in contact with the first conductive roller 21 when it passes to the cleaning area. A cleaning device 41 which can be, but not limited to, a brush comes in contact with the photoreceptor component 1 in the cleaning area. The first A.C. source causes the piezo-active layer 3 of the photoreceptor component 1 to vibrate. The combination of the cleaning device 41 and the vibration of the photoreceptor component 1 produces an improved removal of residual toner from the photoreceptor component 1. After the residual toner is removed from the photoreceptive layer 7, the photoreceptor component 1 is then prepared for exposure to light. The electrostatographic reproduction process described above repeats cyclically along a path as shown generally by an arrow.

There are many variations of the aforementioned embodiment. First of all, the photoreceptive layer 7 of FIG. 1 is not limited to inorganic compounds such as amorphous selenium, but includes organic materials that produce similar results. Also, the invention is not limited to belt-type photoreceptor components and may include plate or drum-type photoreceptor components as well.

The present invention has applications in ionography, which is well known in the art. A disclosed method of ionographic imaging is seen in U.S. Pat. Nos. 4,524,371 to Sheridan et al. and 4,463,363 to Gundlach, and in *Electrophotography* by R. M. Schaeffert, published by John Wiley & Sons, 1975 at pages 199–201, the disclosures of which are incorporated herein by reference in their entirety. In this electroradiographic process, an x-ray image is developed on an insulator plate. In standard ionographic processes, this plate usually comprises an insulator layer and a conductive layer. The plate can be modified by adding to the insulator sheet a piezo-active layer of a material such as PVDF (Kynar®). By modifying the ionographic plate in this manner, improved development, transfer, and cleaning can be achieved through vibration of the insulator plate as seen in the aforementioned photoreceptive process.

In a special case, the piezo-active film is used as the insulating layer for the ionographic plate. The piezo-active film can then be vibrated in the cleaning area to facilitate improved cleaning of the ionographic plate.

Similar improvements in electrostatographic processes can be obtained by replacing the support layer in the photoreceptive structure 7 (e.g., a layer of Mylar®, or similar material) with the electrode layer 5 and piezo-active layer 3. Also, the electrode layer 3 can be replaced by using a conductive two-sided adhesive tape 4 for adhering the piezo-active layer 3 to the photoreceptive layer 7.

The above is a detailed description of particular embodiments of the invention. The full scope of the invention is set out in the claims that follow and their equivalents. Accordingly, the claims and specification should not be construed to unduly narrow the full scope of protection to which the invention is entitled.

What is claimed:

1. A method of fabricating a photoreceptor, comprising:

forming a belt of a piezo-active material having a uniform thickness and width;

depositing an electrode layer of an electrically conductive material onto said piezo-active belt, said electrode layer having a uniform thickness, said electrode layer also having a uniform width equal to the uniform width of said piezo-active belt;

attaching a photoreceptor structure having photoreceptive properties onto said electrode layer sufficiently to form a photoreceptive belt having a uniform thickness, said photoreceptive belt having a uniform width equal to that of said piezo-active belt; and coupling a ground to said electrode layer.

2. The method of claim 1, further comprising:

coupling an alternating current corona source to said ground in close proximity to said piezo-active belt, said alternating current corona source supplying an alternating charge signal across said piezo-active belt, said alternating charge signal causing vibration in said piezo-active sheet proximately to said alternating current corona source.

3. The method of claim 1, further comprising:

entraining said photoreceptive belt around at least one conductive roller such that said conductive roller is directly coupled to said piezo-active belt of said photoreceptor belt.

4. The method of claim 3, further comprising:

coupling an alternating current voltage source between said ground and said conductive roller, such that said alternating current voltage source supplies an alternating voltage signal across said piezo-active belt to said electrode layer and said ground for vibrating said piezo-active layer proximately to said conductive roller.

5. The method of claim 1, wherein said photoreceptive structure is attached to said electrode layer with a two-sided, pressure-sensitive adhesive tape.

6. The method of claim 2, wherein said photoreceptive structure is attached to said electrode layer with a two-sided, pressure-sensitive adhesive tape.

7. The method of claim 3, wherein said photoreceptive structure is attached to said electrode layer with a two-sided, pressure-sensitive adhesive tape.

8. The method of claim 4, wherein said photoreceptive structure is attached to said electrode layer with a two-sided, pressure-sensitive adhesive tape.

9. The method of claim 1, wherein said photoreceptive structure is attached to said electrode layer with a two-sided, heat-activated adhesive tape.

10. The method of claim 2, wherein said photoreceptive structure is attached to said electrode layer with a two-sided, heat-activated adhesive tape.

11. The method of claim 3, wherein said photoreceptive structure is attached to said electrode layer with a two-sided, heat-activated adhesive tape.

12. The method of claim 4, wherein said photoreceptive structure is attached to said electrode layer with a two-sided, heat-activated adhesive tape.

13. The method of claim 1, wherein said photoreceptive structure is attached to said electrode layer with an adhesive.

14. The method of claim 2, wherein said photoreceptive structure is attached to said electrode layer with an adhesive.

15. The method of claim 3, wherein said photoreceptive structure is attached to said electrode layer with an adhesive.

16. The method of claim 4, wherein said photoreceptive structure is attached to said electrode layer with an adhesive.

17. A method of fabricating a photoreceptor, comprising:

forming a sheet of a piezo-active material having a uniform thickness and width, said piezo-active sheet having first and second ends;

adhering an electrode layer of an electrically conductive material onto said piezo-active sheet, said electrode layer having a uniform thickness, said electrode layer also having a uniform width equal to the uniform width of said piezo-active sheet, said electrode layer having first and second ends corresponding to said first and second ends of said piezo-active sheet;

attaching a photoreceptive structure having photoreceptive properties onto said electrode layer to form a photoreceptive layer having a uniform thickness, said photoreceptive layer having a uniform width equal to that of said piezo-active sheet, said photoreceptive layer having first and second ends corresponding to said first and second ends of said piezo-active sheet;

coupling together said first and second ends of said piezo-active sheet, electrode layer, and photoreceptive layer, to form a photoreceptor belt; and coupling a ground to said electrode layer.

18. The method of claim 17 wherein said electrode layer is a conductive, two-sided adhesive tape.

19. The method of claim 18, further comprising:

coupling an alternating current corona source to said ground in close proximity to said piezo-active sheet, said alternating current corona source supplying an alternating charge signal across said piezo-active layer, said alternating charge signal causing vibration in said piezo-active sheet.

20. The method of claim 18, further comprising:

entraining said photoreceptor belt around at least one conductive roller such that said conductive roller is directly coupled to said piezo-active layer of said photoreceptor belt.

21. The method of claim 20, further comprising:

coupling an alternating current voltage source between said ground and said conductive roller, such that said alternating current voltage source supplies an alternating voltage signal across said piezo-active layer to said electrode layer and said ground for vibrating said piezo-active layer.

22. The method of claim 17 wherein said electrode layer is a conductive adhesive.

23. The method of claim 22, further comprising:

coupling an alternating current corona source to said ground in close proximity to said piezo-active sheet, said alternating current corona source supplying an alternating charge signal across said piezo-active layer, said alternating charge signal causing vibration in said piezo-active sheet.

24. The method of claim 22, further comprising:

entraining said photoreceptor belt around at least one conductive roller such that said conductive roller is directly coupled to said piezo-active layer of said photoreceptor belt.

25. The method of claim 24, further comprising:

coupling an alternating current voltage source between said ground and said conductive roller, such that said alternating current voltage source supplies an alternating voltage signal across said piezo-active layer to said electrode layer and said ground for vibrating said piezo-active layer.

26. A method of fabricating an ionographic plate comprising:

forming a sheet of an insulating material having a uniform thickness, and a length and width;

depositing an electrode layer of an electrically conductive material onto said insulating material sheet, said electrode layer also having a length and width equal to the length and width of said insulating material sheet;

attaching a sheet of piezo-active material to said insulating material sheet, said piezo-active material sheet having a length and width equal to the length and width of said insulating material sheet; and coupling a ground to said electrode layer.

27. The method of claim 26, further comprising:

coupling an alternating current corona source to said ground in close proximity to said piezo-active material sheet, said alternating current corona source supplying an alternating charge signal across said piezo-active material sheet, said alternating charge signal causing vibration in said piezo-active sheet proximately to said alternating current corona source.

28. The method of claim 26, further comprising:

coupling an electrode device to said electrode layer;

coupling an alternating current voltage source between said ground and said electrode device, such that said alternating current voltage source supplies an alternating voltage signal across said piezo-active material sheet to said electrode layer and said ground for vibrating said piezo-active layer proximately to said electrode device.

29. A method of fabricating an ionographic plate comprising:

forming a sheet of an insulating material having a uniform thickness, and a length and width, said insulating material sheet being made of a piezo-active material;

depositing an electrode layer of an electrically conductive material onto said insulating material sheet, said electrode layer also having a length and width equal to the length and width of said insulating material sheet; and coupling a ground to said electrode layer.

30. The method of claim 29, further comprising:

coupling an alternating current corona source to said ground in close proximity to said insulating material sheet, said alternating current corona source supplying an alternating charge signal across said piezo-active material, said alternating charge signal causing vibration in said piezo-active material proximately to said alternating current corona source.

31. The method of claim 29, further comprising:

coupling an electrode device to said electrode layer;

coupling an alternating current voltage source between said ground and said electrode device, such that said alternating current voltage source supplies an alternating voltage signal across said piezo-active material of said insulating material sheet to said electrode layer and said ground for vibrating said piezo-active material proximately to said electrode device.

* * * * *